US005174566A

United States Patent [19]

Kelnhofer

[11] Patent Number: 5,174,566

[45] Date of Patent: Dec. 29, 1992

[54] TRAINING DEVICE FOR GOLFERS

[75] Inventor: George L. Kelnhofer, Gwinnett County, Ga.

[73] Assignee: Swing Systems Inc., Atlanta, Ga.

[21] Appl. No.: 767,403

[22] Filed: Sep. 30, 1991

[51] Int. Cl.[5] ..... A63B 69/36

[52] U.S. Cl. ..... 273/35 A; 273/187 A; 435/252

[58] Field of Search ..... 273/35 A, 187 R, 187 A, 273/183 A, 183 E; 359/838, 882; 435/252

[56] References Cited

U.S. PATENT DOCUMENTS 3,915,457 10/1975 Casey ..... 273/35 A X

FOREIGN PATENT DOCUMENTS 2565722 12/1985 France ..... 273/35 A 2130103 5/1984 United Kingdom ..... 273/35 A

*Primary Examiner*—George J. Marlo

*Attorney, Agent, or Firm*—Patrick F. Henry, Sr.

[57] ABSTRACT

A mirror has a diagram of preferred movements and a practicing person, such as a golfer practicing a proper golf swing which is diagrammed on the mirror, stands in front of the mirror and follows the diagram. The diagram has lines to be followed, for example, 2 straight vertical lines 1 and 2 for locating the person, intersecting straight angled lines 4 and 5 intersecting each other and the lines 1 and 2 and a diagonal line 3 intersecting the lines 1, 2, 4 and 5 for guiding the swing. The diagram may be a decal on the mirror, a removable clear plastic sheet attached to the mirror, or indicated directly on the mirror by paint, crayon, and the like. The person can be provided with written or private instructions, or a video tape.

4 Claims, 2 Drawing Sheets

TRAINING DEVICE FOR GOLFERS

BACKGROUND OF THE INVENTION

1. Field of the Invention

For the purpose of training a person to repeat movement (e.g. swing a golf club in the correct way each time the club is swung) a reflective surface, such as a mirror or a reflective glass, is provided with guidelines so that the person can see his or her image and follow the guidelines with the club going up and coming back down.

2. Description or Prior Procedures

It is known previously to produce a moving image from an optical source such as a movie projector or video recorder and to project that image on a screen so that a person practicing a golf swing, a tennis swing or the like can attempt to follow that image. Such devices and procedures are shown in prior U.S. Pat. Nos. 3,000,261; 3,353,282. It is also known to make motion pictures or video pictures and to review and analyze such pictures in conjunction with swinging a golf club, such as shown in U.S. Pat. No. 2,939,224. Also, mirrors have been used so that the person practicing a swing can observe same in a mirror during motion such as shown in U.S. Pat. Nos. 1,558,762; 3,611,591; 3,915,457 and Des 198,459. However, none of these procedures and devices provides any guiding diagram on a reflective surface so that the person practicing the swing can follow a pattern while viewing a reflection in a mirror or other reflecting surface.

An object of this invention is to provide a reflective means whereby a person practicing a golf swing or other activity follows a pattern on the reflective surface so as to follow same while swinging.

Another object of this invention is to provide a golf practice device utilizing a reflective surface such as a mirror and a guide means on the mirror without the use of optical devices, cameras, or other apparatus.

Still another advantage of the present invention resides in the use of straight lines which are followed by following a reflected image located with respect to said lines.

Another advantage of the present invention is that the person practicing the swing or activity does not try to follow a series of images which establish the proper movement but rather follows a pattern which does not move but rather remains stationary and is followed.

Other and further objects and advantages of this invention will become apparent upon reading the following description or a preferred embodiment taken in conjunction with the accompanying drawings.

DESCRIPTION OF A PREFERRED EMBODIMENT

Figure 1:
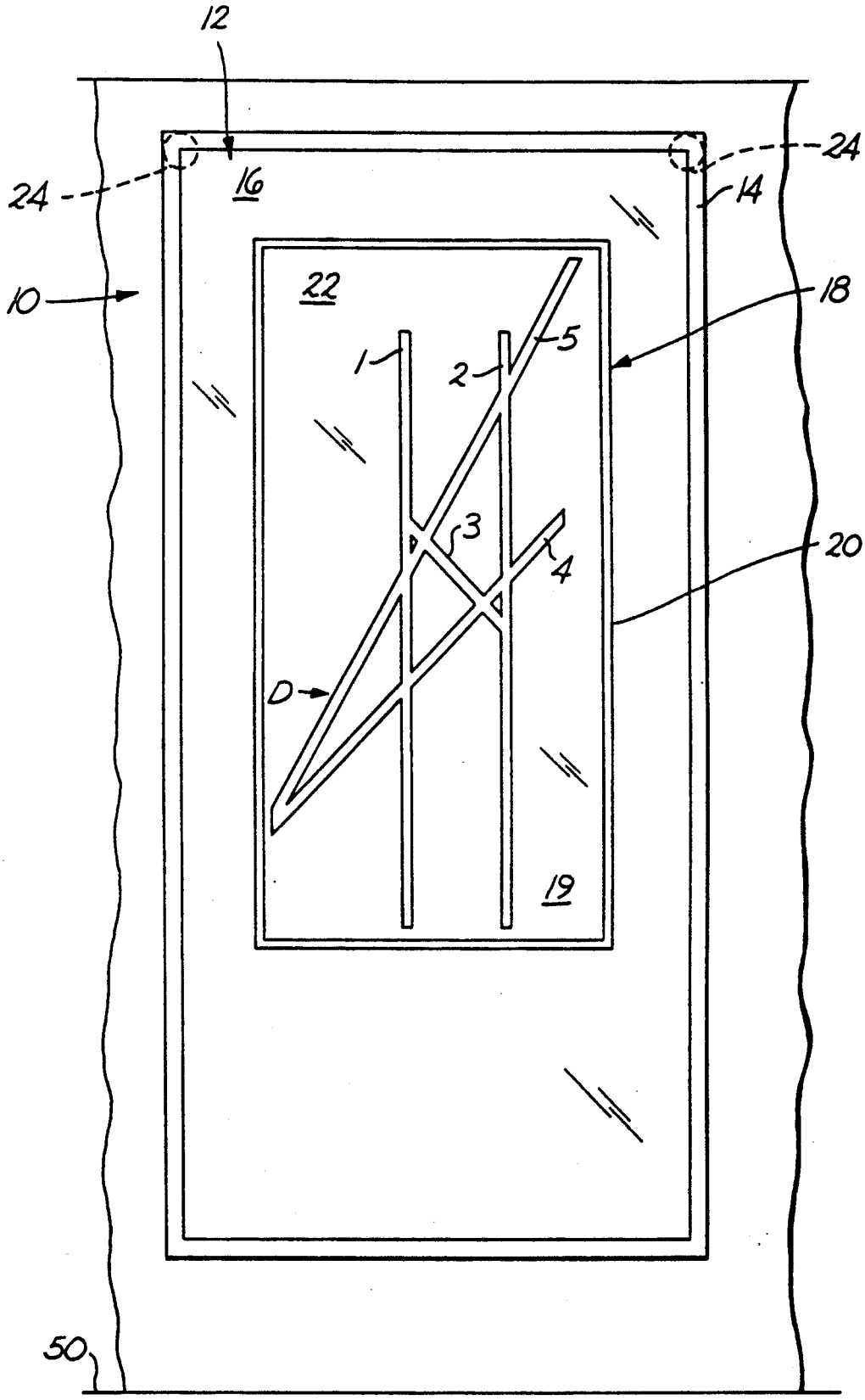
FIG. 1 is an elevation view of the present device which includes a mirror and a diagram superimposed thereon.

A wall 10 of a room supports a large vertical mirror 12 mounted in a mirror frame 14 to provide a substantially vertical reflecting surface 16 on which is mounted a transparent trainer 18 including sheet 19 having a border 20 supported by suction cups 24 attached to the reflecting surface 16. The material, such as plastic, of the sheet 18 is transparent so that the reflective surface 16 of the mirror reflects an image in front of the reflective surface 16 through the sheet 18 so that a person P, such as one practicing a golf swing, can stand in front of the mirror and see the person P's image in the mirror 12 through the sheet 18.

Lines 1–5 are guidelines indicated as a diagram D on the surface of the transparent sheet 19, or directly on mirror 12, such as by printing in ink, painting, thin tape, etc. Lines 1 and 2 are vertical lines used for alignment with respect to a practicing person P's pants fly or crotch and the left ear. Line 2 is approximately 8 centimeters from line 1 and may be approximately between 6 and 10 centimeters. Line 2 is used for the top of the backswing. The shoulder of the person P is lifted along this line 2 and the right hip is just inside of it.

Line 3 is a line perpendicular to line 4 and represents the angle of the person P's back at the top of the backswing. Line 4 is between 40 degrees and 50 degrees to the ground for an average of approximately 45 degrees. Line 4 is for the travel of the person P's hands and the golf shaft 48 up until the shaft 48 is parallel to the ground. Line 5 is between 50 degrees and 65 degrees to the ground and intersects Line 4. Line 5 is for the hands and club shaft.

Figure 2:
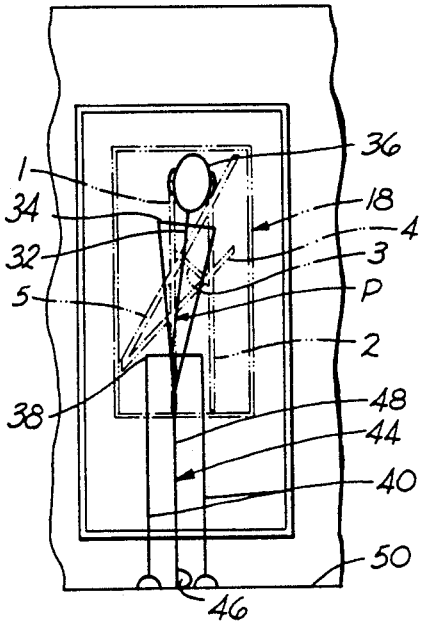
FIGS. 2–5 are a series of diagrams illustrating the use of the device in FIG. 1 by person shown diagrammatically as a "stick person" standing in front of the reflective surface.
Figure 3:
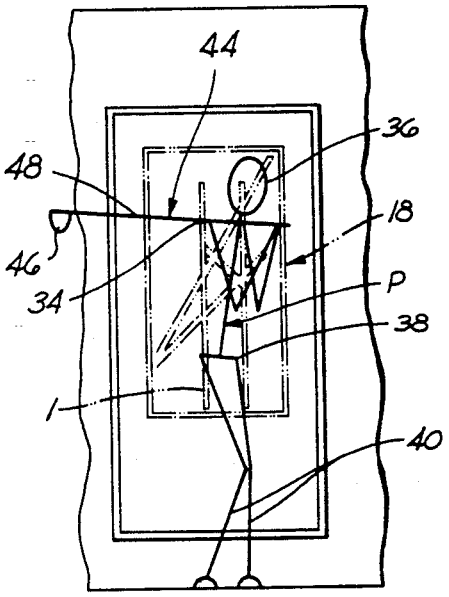
Figure 4:
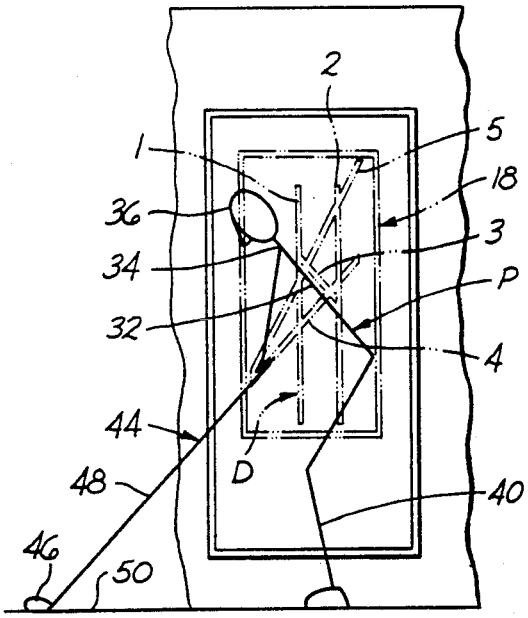
Figure 5:
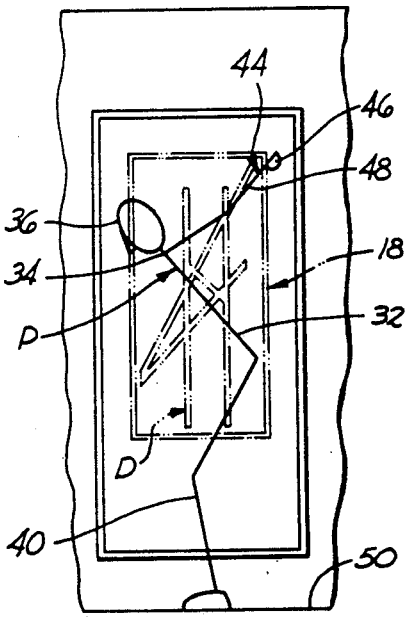

Referring to the diagrammatic views of FIG. 2–5 inclusive, the person P is shown in the form of a stick person having a body 32, shoulders 34, head 36, hips 38, and legs 40. In each of the FIGS. 2–5 inclusive the person P is holding a typical golf club 44 having a club head 46 and of course the person P practicing in front of this sheet trainer 18 is basically familiar with the procedure for holding the golf club 44, shaft 48 so as to address a golf ball (not shown) on the ground 50 and raise the club head 46 up to the top of the swing and rapidly back down again to strike the golf ball.

Procedure for the Person P Using Trainer 18

1. Place trainer SHEET 19 on mirror 12 (or sliding glass door) approximately 76 centimeters from floor or ground 50. Use suction cups 24, velcro fasteners, tape or other methods to adhere to surface 16.

2. Position "V" formed by the meeting of lines 4 and 5 to left for right handed golfer or turn trainer over and have it on the right for a left handed golfer.

3. Person P faces trainer 18 and stand approximately 2.5 meters away. For a driver, put fly of pants and left ear on line 1. The inside of heels should be as wide as the outside of shoulders.

4. Go to the top of the backswing. Left shoulder should be on line 2 and right hip just inside line 2. This is a perfect pivot.

5. Next, stand with the trainer 18 to the right. The golf club shaft should be on line 4 and back of person P should be parallel to line 3. Note: to attain this, trainer 18 may have to be raised or lowered slightly.

6. Move club 44 back on line 4 until the shaft is parallel to the ground. The club face should be perpendicular (90 degrees) to line 4. The entire shaft should stay on the line all the way back.

7. Take the club 44 to the top of your backswing. Hands, butt of club and shaft should be on line 5. Clubface should be perpendicular (90 degrees) to line 5. NO PART OF THE CLUB OR HANDS SHOULD EVER GET BELOW LINE 4 OR ABOVE LINE 5.

8. In slow motion make down swing move with clubhead below line 4. In regular speed clubhead will be on line 4 because body rotation will pull clubshaft and right forearm in a straight line.

Continued practice for both pivot and plane will assist in hitting shots more squarely and accurately and should result in lower scores and a more well rounded and constant game.

While I have shown and described a preferred embodiment of the invention together with a suggested procedure for the use this is by way of illustration only and does not constitute any limitation on the invention since there are various changes, deviations, revisions and departures which may be made from the preferred embodiment and procedure without avoiding the scope of this invention as defined in the appended claims.

I claim:

1. In a training device for a person practicing a movement, for example a golf swing:

a reflective surface having a diagram with guidelines thereon whereby a person standing in front of said reflective surface sees the person's image and the guidelines together reflected from the reflective surface, so that said person may follow said guidelines during movement such as the travel of a golf club head and shaft to the top of the backswing and thence down again to the ground, said diagram including substantially vertical straight guidelines 1 and 2 defining a space therebetween for the location of the person's body while standing in front of the guidelines 1 and 2 and there being other guidelines for the location of the travel of the golf club head during the backswing and return to the ground, said other guidelines being angular, intersecting straight guidelines 4 and 5 intersecting each other and the two vertical guidelines 1 and 2, and a diagonal line 3, guideline 2 being a reference for the backswing, guideline 3 indicating the angle of the person's back at the top of the backswing, guideline 4 being for the travel of the hands and the golf shaft up until the shaft is parallel to the ground, guideline 5 being for the hands and club shaft, whereby the person stands away from the reflective surface by location with guidelines 1 and 2 and thereafter follows the intersecting guidelines 4 and 5 to practice the movement of the golf swing.

2. The device in claim 1 wherein the reflective surface is a mirror and the diagram is on said mirror.

3. The device in claim 1 wherein guideline 4 is between approximately 45 degrees and 50 degrees to the ground.

4. The device in claim 1 wherein guideline 5 is approximately between 50 degrees and 65 degrees to the ground.

* * * * *